US010216146B2

(12) United States Patent
Chabloz

(10) Patent No.: US 10,216,146 B2
(45) Date of Patent: Feb. 26, 2019

(54) INDICATOR ACTUATING ORGAN FOR A TIMEPIECE

(71) Applicant: PATEK PHILIPPE SA GENEVE, Geneva (CH)

(72) Inventor: David Chabloz, Sallanches (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 0 days.

(21) Appl. No.: 15/652,862

(22) Filed: Jul. 18, 2017

(65) Prior Publication Data

US 2019/0025761 A1 Jan. 24, 2019

(51) Int. Cl.
*G04B 19/02* (2006.01)
*G04B 19/04* (2006.01)

(52) U.S. Cl.
CPC ..... *G04B 19/02* (2013.01); *G04B 19/04* (2013.01)

(58) Field of Classification Search
CPC ..... G04B 19/02; G04B 19/04; G04B 17/045; G04B 17/04; G04B 17/06; G04B 17/20; G04B 17/26; G04B 17/28; G04B 13/025; G04C 3/101
USPC ..... 368/220
See application file for complete search history.

(56) References Cited

U.S. PATENT DOCUMENTS 9,836,024 B2 * 12/2017 Di Domenico ..... G04B 17/045
2009/0067295 A1 * 3/2009 Gil ..... G04B 19/02 368/69
2011/0044139 A1 * 2/2011 Henein ..... G04B 17/00 368/125
2015/0331390 A1 * 11/2015 Gruenig ..... G04B 15/08 368/132
2017/0212473 A1 * 7/2017 Wiederrecht ..... G04B 17/325

FOREIGN PATENT DOCUMENTS

CH 702137 B1 5/2011

* cited by examiner

*Primary Examiner* — Edwin A. Leon
(74) *Attorney, Agent, or Firm* — Young & Thompson

(57) ABSTRACT

An actuating organ for actuating an indicator in a timepiece, including: a fixing portion; a mobile portion; a first elastic portion connecting the mobile and fixing portions, the first elastic portion guiding the mobile portion relative to the fixing portion and exerting an elastic return action on the mobile portion; an actuation portion engaging with a toothed component of the timepiece upon actuation of the mobile portion relative to the fixing portion to actuate the toothed component, thereby actuating the indicator; and a second elastic portion connecting the actuation portion to the mobile portion, the second elastic portion being arranged to guide the actuation portion relative to the mobile portion so as to allow the actuation portion to retract when leaving the toothed component after release of the mobile portion, the second elastic portion being also arranged to exert an elastic return action on the actuation portion.

20 Claims, 3 Drawing Sheets

INDICATOR ACTUATING ORGAN FOR A TIMEPIECE

BACKGROUND OF THE INVENTION

Field of the Invention

The present invention relates to an indicator actuating organ for a timepiece and to a timepiece, typically a wrist watch or a pocket watch, incorporating it.

The indicator actuating organ is for example a corrector that may be actuated manually from the outside of the timepiece to set the position of an indicator, such as a local time hour indicator or a date indicator.

Alternatively, the indicator actuating organ is a driving organ controlled by a cam and arranged to drive a toothed component that carries the indicator during normal operation of the timepiece.

Description of the Related Art

Known indicator actuating organs have several drawbacks. They need lubrication at their rotating point to reduce friction and wear. They also require the use of a separate component acting as a return spring.

The present invention aims at remedying these drawbacks.

SUMMARY OF THE INVENTION

To this end there is provided an actuating organ for actuating an indicator in a timepiece, said actuating organ comprising:

a fixing portion, a mobile portion, a first elastic portion connecting the mobile portion to the fixing portion, said first elastic portion being arranged to guide the mobile portion relative to the fixing portion and to exert an elastic return action on the mobile portion, an actuation portion arranged to engage with a toothed component of the timepiece upon actuation of the mobile portion relative to the fixing portion so as to actuate said toothed component, thereby actuating said indicator, and a second elastic portion connecting the actuation portion to the mobile portion, said second elastic portion being arranged to guide the actuation portion relative to the mobile portion so as to allow the actuation portion to retract when leaving the toothed component after release of the mobile portion, said second elastic portion being also arranged to exert an elastic return action on the actuation portion.

The present invention also provides an actuating organ for actuating an indicator in a timepiece, said actuating organ comprising:

a fixing portion, a first mobile portion, a first elastic portion connecting the first mobile portion to the fixing portion, said first elastic portion being arranged to guide the first mobile portion relative to the fixing portion and to exert an elastic return action on the first mobile portion, a first actuation portion arranged to engage with a toothed component of the timepiece upon actuation of the first mobile portion relative to the fixing portion, so as to actuate said toothed component in a first direction, thereby actuating said indicator, a second elastic portion connecting the first actuation portion to the first mobile portion, said second elastic portion being arranged to guide the first actuation portion relative to the first mobile portion so as to allow the first actuation portion to retract when leaving the toothed component after release of the first mobile portion, said second elastic portion being also arranged to exert an elastic return action on the first actuation portion, a second mobile portion, a third elastic portion connecting the second mobile portion to the fixing portion, said third elastic portion being arranged to guide the second mobile portion relative to the fixing portion and to exert an elastic return action on the second mobile portion, a second actuation portion arranged to engage with said toothed component of the timepiece upon actuation of the second mobile portion relative to the fixing portion, so as to actuate said toothed component in a second direction, opposite to said first direction, thereby actuating said indicator, and a fourth elastic portion connecting the second actuation portion to the second mobile portion, said fourth elastic portion being arranged to guide the second actuation portion relative to the second mobile portion so as to allow the second actuation portion to retract when leaving the toothed component after release of the second mobile portion, said fourth elastic portion being also arranged to exert an elastic return action on the second actuation portion.

The present invention further provides a timepiece mechanism comprising an actuating organ, a toothed component for driving an indicator and an isolating organ, said actuating organ comprising:

a fixing portion, a first mobile portion, a first elastic portion connecting the first mobile portion to the fixing portion, said first elastic portion being arranged to guide the first mobile portion relative to the fixing portion and to exert an elastic return action on the first mobile portion, a first actuation portion arranged to engage with the toothed component upon actuation of the first mobile portion relative to the fixing portion, so as to actuate the toothed component in a first direction, thereby actuating said indicator, a second elastic portion connecting the first actuation portion to the first mobile portion, said second elastic portion being arranged to guide the first actuation portion relative to the first mobile portion so as to allow the first actuation portion to retract when leaving the toothed component after release of the first mobile portion, said second elastic portion being also arranged to exert an elastic return action on the first actuation portion, a second mobile portion, a third elastic portion connecting the second mobile portion to the fixing portion, said third elastic portion being arranged to guide the second mobile portion relative to the fixing portion and to exert an elastic return action on the second mobile portion, a second actuation portion arranged to engage with the toothed component upon actuation of the second mobile portion relative to the fixing portion, so as to actuate the toothed component in a second direction, opposite to said first direction, thereby actuating said indicator, and a fourth elastic portion connecting the second actuation portion to the second mobile portion, said fourth elastic portion being arranged to guide the second actuation portion relative to the second mobile portion so as to allow the second actuation portion to retract when leaving the toothed component after release of the second mobile portion, said fourth elastic portion being also arranged to exert an elastic return action on the second actuation portion, wherein the isolating organ is arranged to be moved by one of the first and second mobile portions upon actuation of said one of the first and second mobile portions to prevent the actuation portion corresponding to the other of the first and second mobile portions from engaging with the toothed component if said other of the first and second mobile portions is actuated.

The present invention further provides a timepiece comprising one of the above-defined actuating organs or the above-defined timepiece mechanism.

BRIEF DESCRIPTION OF THE DRAWINGS

Other features and advantages of the present invention will become apparent upon reading the following detailed description made with reference to the appended drawings in which.

DESCRIPTION OF THE PREFERRED EMBODIMENTS

Figure 1:
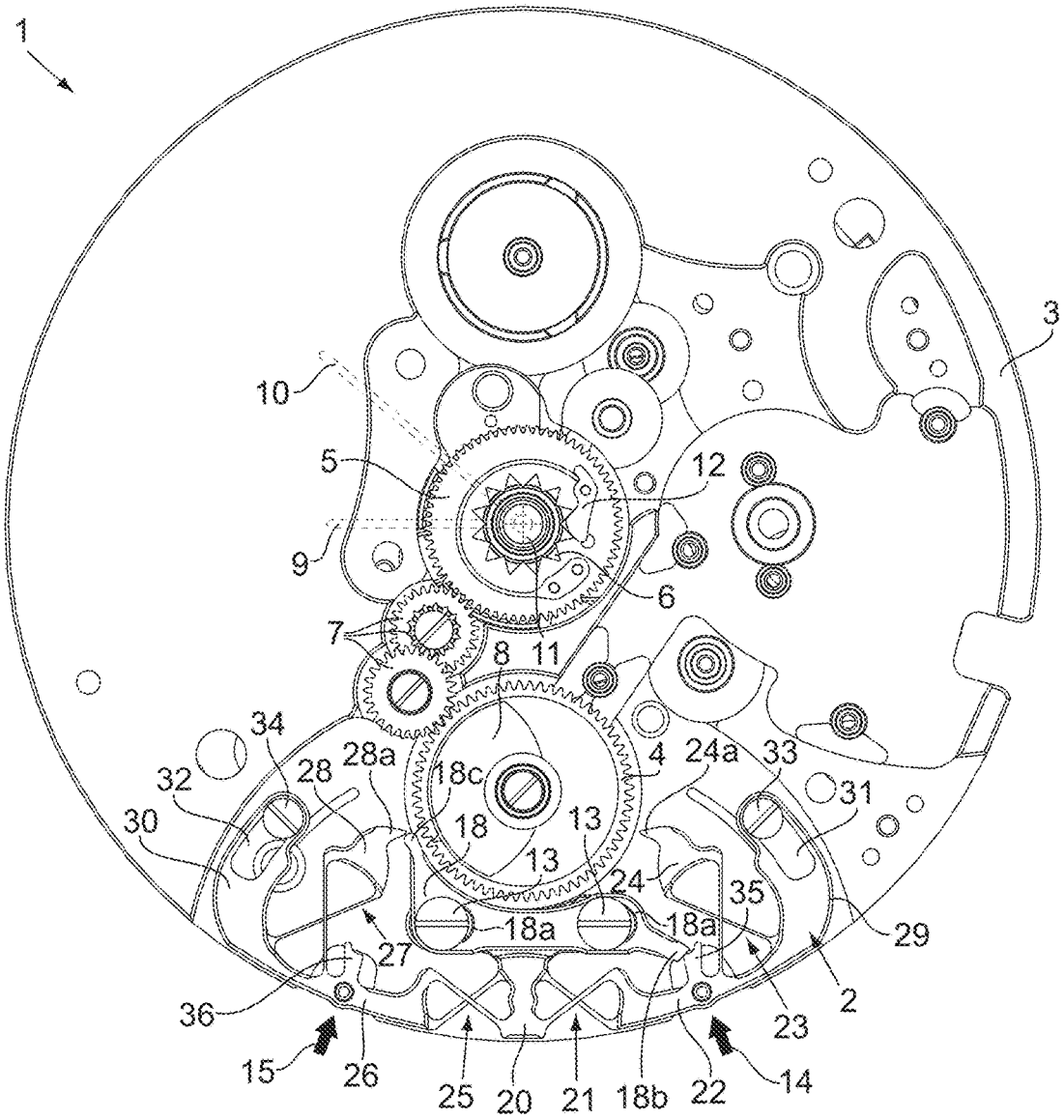
FIG. 1 is a planar top view of part of a timepiece mechanism including an indicator actuating organ according to a preferred embodiment of the invention.
Figure 2:
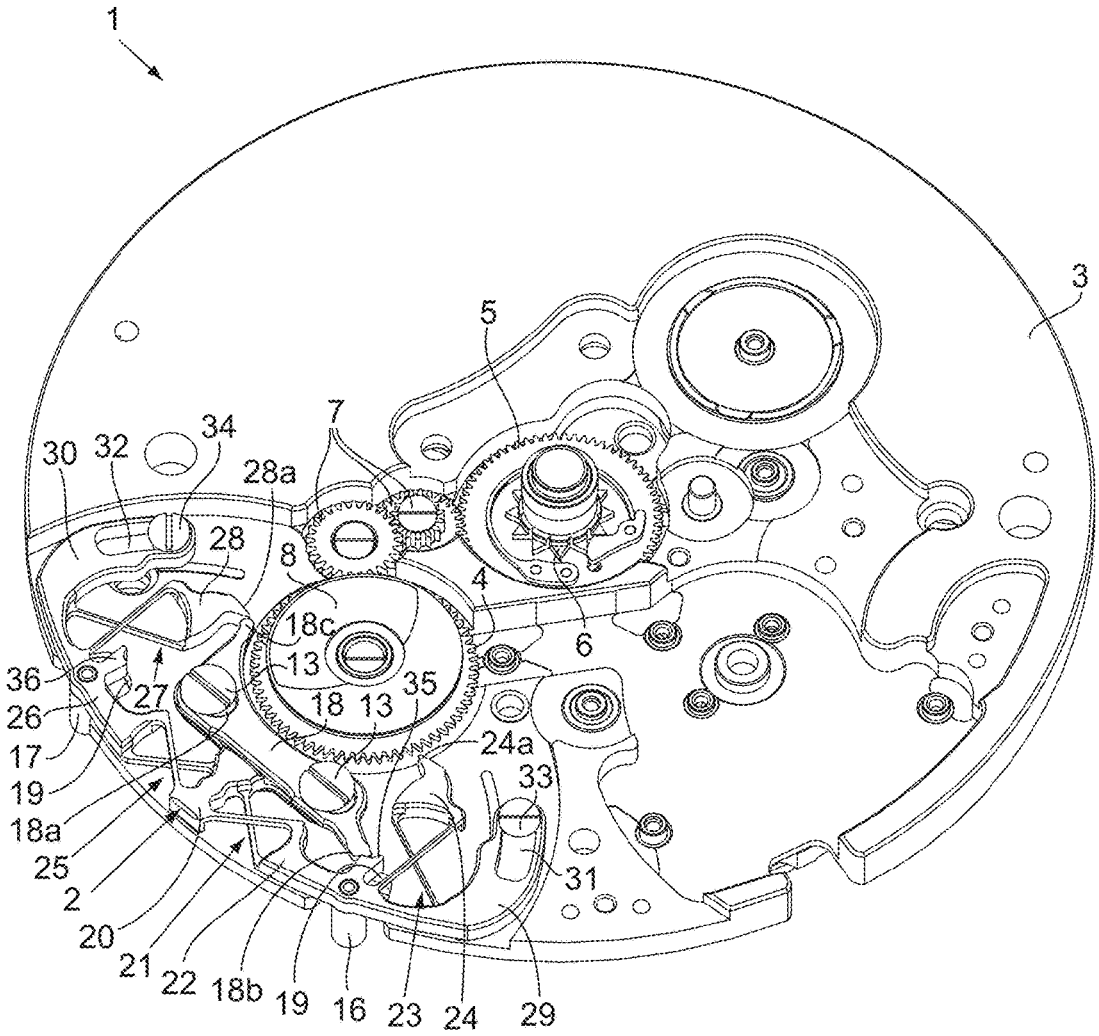
FIG. 2 is a perspective top view of said part of a timepiece mechanism.

FIGS. 1 and 2 show part of a timepiece mechanism 1 including an indicator actuating organ 2 according to a preferred embodiment of the invention. In this embodiment, the indicator actuating organ 2 is a corrector. The timepiece mechanism 1 comprises a plate 3 on which are mounted mobile components, the plate 3 being itself mounted on a base movement (not shown). Among these mobile components are a 24-hour wheel 4 which is rotated at a rate of one revolution per 24 hours, a local time hour wheel 5 which is rotated at a rate of one revolution per 12 hours, a home time hour star wheel 6 and intermediate wheels 7 which kinematically connect the 24-hour wheel 4 and the local time hour wheel 5 to each other.

The 24-hour wheel 4 carries a day/night indicator 8, typically in the form of a disc, as well as a finger (not shown) which is arranged to rotate a wheel carrying a date indicator (not shown) by one pitch at the end of each day. The local time hour wheel 5 carries a local time hour indicator 9, typically in the form of a hand (diagrammatically shown in dashed line in FIG. 1), indicating the hour in the time zone in which the user is located. The home time hour star wheel 6 carries a home time hour indicator 10, typically in the form of a hand (diagrammatically shown in dashed line), indicating the hour in the time zone where the user resides.

The home time hour star wheel 6 is mounted on the same arbor 11 as the local time hour wheel 5 but is mounted on this arbor 11 so as to be free to rotate relative to the local time hour wheel 5. A jumper 12 mounted on the local time hour wheel 5 and engaged with the home time hour star wheel 6 keeps the two wheels 5, 6 rotationally fixed to each other during normal operation of the timepiece mechanism 1.

In normal operation, the home time hour star wheel 6 is driven by the base movement and the rotation of the home time hour star wheel 6 causes a same rotation of the local time hour wheel 5 due to the engagement between the jumper 12 and the home time hour star wheel 6. The rotation of the local time hour wheel 5 causes a rotation of the 24-hour wheel 4 via the intermediate wheels 7. The corrector 2 according to the invention is arranged to act on the 24-hour wheel 4 so as to enable a user to correct the position of the local time hour indicator 9 and, consequently, the positions of the day/night indicator 8 and of the date indicator driving finger carried by the 24-hour wheel 4. The local time hour correction by means of the corrector 2 may be done while the timepiece mechanism 1 is operating.

Figure 3:
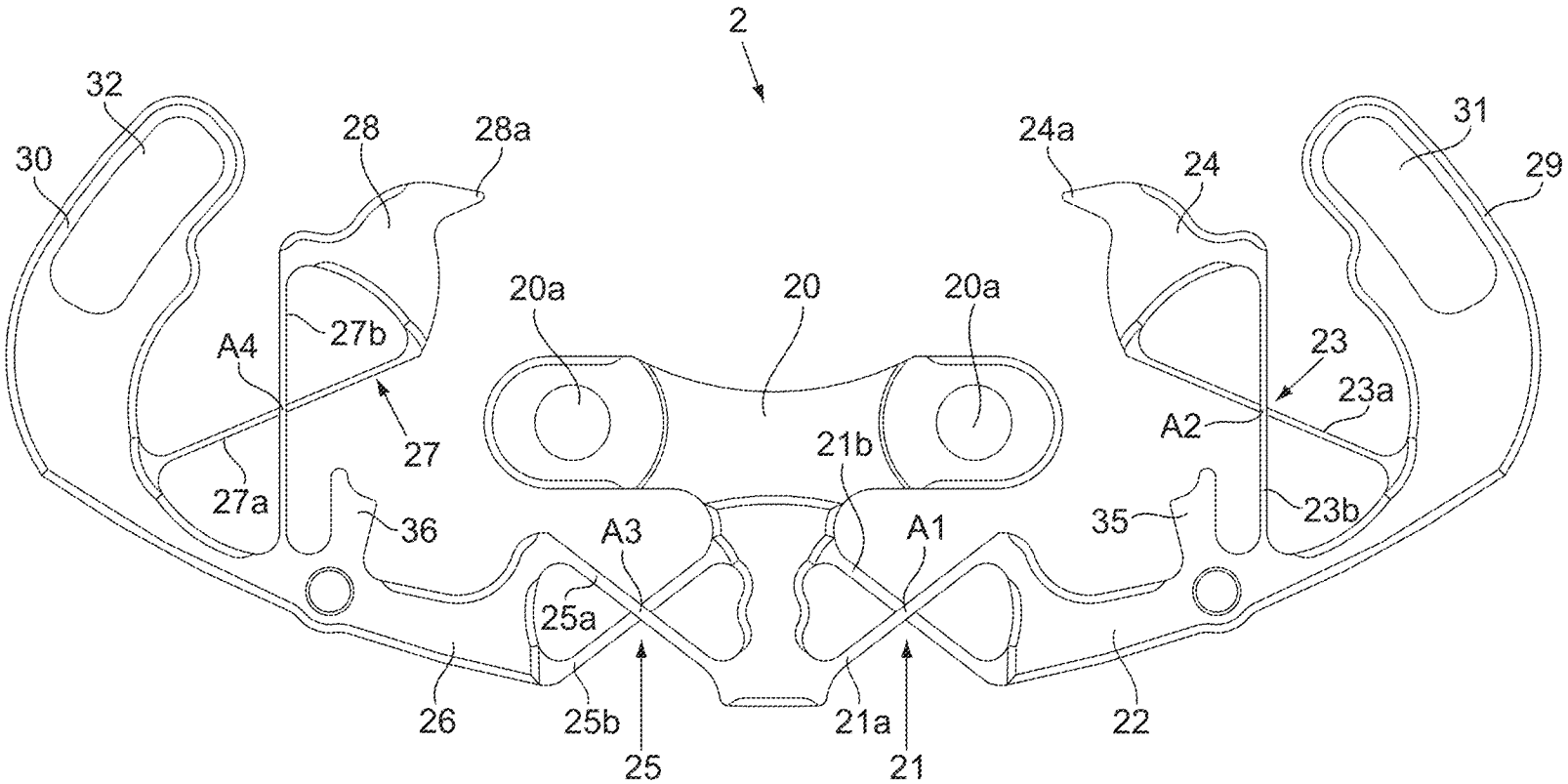
FIG. 3 is a planar top view of the indicator actuating organ according to the preferred embodiment of the invention.

Referring to FIG. 3, the corrector 2 is preferably made of one piece, as shown. It has a symmetrical shape and comprises a fixing portion 20, on one side of the fixing portion 20, a first elastic portion 21, a first mobile portion 22 suspended to the fixing portion 20 by the first elastic portion 21, a second elastic portion 23 and a first actuation portion 24 suspended to the first mobile portion 22 by the second elastic portion 23, on the other side of the fixing portion 20, a third elastic portion 25, a second mobile portion 26 suspended to the fixing portion 20 by the third elastic portion 25, a fourth elastic portion 27 and a second actuation portion 28 suspended to the second mobile portion 26 by the fourth elastic portion 27.

The fixing portion 20, the first and second mobile portions 22, 26 and the first and second actuation portions 24, 28 are typically rigid.

The fixing portion 20 is the portion by which the corrector 2 may be fixed to the plate 3. In the example shown, the fixing portion 20 has a T shape, with the horizontal branch of the T having holes 20*a* allowing passage of screws 13 (see FIGS. 1 and 2), and with the vertical branch of the T being joined to the first and third elastic portions 21, 25.

The first and second actuation portions 24, 28 each have a beak 24*a*, 28*a* that is designed to engage with the toothed periphery of the 24-hour wheel 4.

Still referring to FIG. 3, the first elastic portion 21 connects the first mobile portion 22 to the fixing portion 20, is arranged to guide the first mobile portion 22 in rotation relative to the fixing portion 20 around an axis A1 that is perpendicular to the plane of the corrector 2 and to the plane of the plate 3, and is also arranged to elastically return the first mobile portion 22 to a rest position relative to the fixing portion 20 when the first mobile portion 22 is moved away from this rest position.

The second elastic portion 23 connects the first actuation portion 24 to the first mobile portion 22, is arranged to guide the first actuation portion 24 in rotation relative to the first mobile portion 22 around an axis A2 that is perpendicular to the plane of the corrector 2 and to the plane of the plate 3, and is also arranged to elastically return the first actuation portion 24 to a rest position relative to the first mobile portion 22 when the first actuation portion 24 is moved away from this rest position.

The third elastic portion 25 connects the second mobile portion 26 to the fixing portion 20, is arranged to guide the second mobile portion 26 in rotation relative to the fixing portion 20 around an axis A3 that is perpendicular to the plane of the corrector 2 and to the plane of the plate 3, and is also arranged to elastically return the second mobile portion 26 to a rest position relative to the fixing portion 20 when the second mobile portion 26 is moved away from this rest position.

The fourth elastic portion 27 connects the second actuation portion 28 to the second mobile portion 26, is arranged to guide the second actuation portion 28 in rotation relative to the second mobile portion 26 around an axis A4 that is perpendicular to the plane of the corrector 2 and to the plane of the plate 3, and is also arranged to elastically return the second actuation portion 28 to a rest position relative to the second mobile portion 26 when the second actuation portion 28 is moved away from this rest position.

The first to fourth elastic portions 21, 23, 25, 27 each consist of two elastic strips 21*a*, 21*b*, 23*a*, 23*b*, 25*a*, 25*b*, 27*a*, 27*b* extending in two different planes parallel to the plane of the corrector 2 and crossing each other in top view, the crossing point of the strips corresponding to the rotation axis A1 to A4. However, many variants are possible. For example, the first to fourth elastic portions 21, 23, 25, 27 could each have more than two elastic strips extending in respective parallel planes in order to increase the stiffness perpendicularly to the plane of the corrector 2. In another variant, each elastic portion 21, 23, 25, 27 could comprise two strips extending in a same plane parallel to the plane of the corrector 2 and (physically) crossing each other, the crossing point corresponding to the rotation axis A1 to A4. In still another variant, each elastic portion 21, 23, 25, 27 could be of the RCC type (Remote Compliance Center), i.e. could comprise two strips having a fictitious crossing point located beyond the two strips. Also, the first to fourth elastic portions 21, 23, 25, 27 could be of different types. For example, the first and third elastic portions 21, 25 could be of one type and the second and fourth elastic portions 23, 27 could be of another type. Nevertheless, the embodiment shown, in which all elastic portions 21, 23, 25, 27 consist of separated crossed strips, is preferred because it allows a larger stroke.

One will note that whatever the variant selected for the elastic portions 21, 23, 25, 27, the first and second mobile portions 22, 26 and the first and second actuation portions 24, 28 are held and guided only by the elastic portions 21, 23, 25, 27. No physical axis is required. Therefore, there is no friction, no wear and lubrication is not needed. As long as the elastic limit of the strips is not exceeded, the performance of the corrector 2 will not decline. Moreover, no separate return spring is needed, since the elastic portions 21, 23, 25, 27 exert the required elastic return torque.

The corrector 2 may be fabricated in a silicon-based material using the Deep Reactive Ion Etching (DRIE) technique, in a nickel-based material using the LIGA technique, in a metal or alloy (e.g. steel) by milling, electroerosion or 3D printing, in a metallic glass (amorphous metal) by molding or in glass or sapphire by etching, for example.

In use, the first and second mobile portions 22, 26 may be actuated from the outside of the timepiece by respective first and second push buttons 14, 15 diagrammatically shown in FIG. 1 by arrows. The push buttons 14, 15 may be in the same plane as the corrector 2 to act directly on the first and second mobile portions 22, 26 or may be in a different plane, in which case they may act on pins 16, 17 (see FIG. 2) mounted on the first and second mobile portions 22, 26.

Each time the first push button 14 is actuated, the first mobile portion 22 is rotated around the axis A1 against a return torque exerted by the first elastic portion 21. This causes the beak 24*a* of the first actuation portion 24 to enter the toothed periphery of the 24-hour wheel 4 to rotate the latter by one step of 360°/24 in the anticlockwise direction of FIG. 1, by overcoming the force exerted by the jumper 12 on the home time hour star wheel 6. The local time hour wheel 5 is thus rotated in the clockwise direction of FIG. 1 by one step of 360°/12. Once the first push button 14 is released, the first elastic portion 21 returns the first mobile portion 22 to its rest position, which causes the beak 24*a* of the first actuation portion 24 to leave the toothed periphery of the 24-hour wheel 4. During this motion, the second elastic portion 23 enables the first actuation portion 24 to retract, i.e. to rotate around the axis A2 with respect to the first mobile portion 22, while the beak 24*a* is sliding on a tooth of the 24-hour wheel 4 kept in position by the action of the jumper 12 on the home time hour star wheel 6, thereby preventing the beak 24*a* from moving the 24-hour wheel 4 in the clockwise direction of FIG. 1.

Each time the second push button 15 is actuated, the second mobile portion 26 is rotated around the axis A3 against a return torque exerted by the third elastic portion 25. This causes the beak 28*a* of the second actuation portion 28 to enter the toothed periphery of the 24-hour wheel 4 to rotate the latter by one step of 360°/24 in the clockwise direction of FIG. 1, by overcoming the force exerted by the jumper 12 on the home time hour star wheel 6. The local time hour wheel 5 is thus rotated in the anticlockwise direction of FIG. 1 by one step of 360°/12. Once the second push button 15 is released, the third elastic portion 25 returns the second mobile portion 26 to its rest position, which causes the beak 28*a* of the second actuation portion 28 to leave the toothed periphery of the 24-hour wheel 4. During this motion, the fourth elastic portion 27 enables the second actuation portion 28 to retract, i.e. to rotate around the axis A4 with respect to the second mobile portion 26, while the beak 28*a* is sliding on a tooth of the 24-hour wheel 4 kept in position by the action of the jumper 12 on the home time hour star wheel 6, thereby preventing the beak from moving the 24-hour wheel 4 in the anticlockwise direction of FIG. 1.

Thus, the corrector 2 allows quick correction of the local time hour indication in both directions. Incrementation or decrementation of the local time hour indication may be done while the timepiece base movement and the timepiece mechanism 1 are operating thanks to the jumper 12 which rotationally couples and uncouples the local time hour wheel 5 to the home time hour star wheel 6 which remains kinematically linked to the base movement.

As shown in the figures, the corrector 2 may include at two opposite end portions 29, 30 an oblong hole 31, 32 that is crossed by a screw 33, 34 screwed in the plate 3. Cooperation between the head of the screw 33, 34 and the end portion 29, 30 of the corrector 2 prevents any torsion of the corrector 2 in the variant where the push buttons 14, 15 are in a plane that is different from the plane of the corrector 2. Such oblong holes 31, 32 and screws 33, 34 may be omitted in the variant where the push buttons 14, 15 and the corrector 2 are coplanar.

According to another advantageous feature of the invention, an isolating piece 18 is slidingly mounted on the fixing portion 20. The isolating piece 18 is placed on the horizontal branch of the T-shaped fixing portion 20 and is slidable along the said horizontal branch. For this purpose, the isolating piece 18 has oblong holes 18*a* through which pass the screws 13 that fix the corrector 2 to the plate 3. Between their threaded portion and their head, the screws 13 have a shoulder (not shown) which presses the fixing portion 20 against the plate 3. The isolating piece 18 is placed between the shoulder and the head of the screws 13.

Upon actuation of the first push button 14, a protrusion 35 of the first mobile portion 22 of the corrector 2 pushes a first end 18*b* of the isolating piece 18 to move the isolating piece 18 toward the beak 28*a* of the second actuation portion 28 so that a second end 18*c* of the isolating piece 18 forms a stop for the beak 28*a* preventing it from entering the toothed periphery of the 24-hour wheel 4 if the second push button 15 is actuated. Thus, if both push buttons 14, 15 are pressed simultaneously, only the beak 24*a* of the first actuation portion 24 will engage with the 24-hour wheel 4. In this manner, application of antagonistic torques on the 24-hour wheel 4, which could plastically deform or break the elastic portions 21, 23, 25, 27 or break other parts in the mechanism, is avoided.

Instead of prioritizing the first push button 14, the isolating piece 18 could be turned over so as to prioritize the second push button 15. In this case, a protrusion 36 of the second mobile portion 26 of the corrector 2 would act on the isolating piece 18 to prevent the beak 24*a* of the first actuation portion 24 from entering the toothed periphery of the 24-hour wheel 4 when both push buttons 14, 15 are simultaneously pressed.

The corrector 2 and/or the timepiece mechanism 1 may comprise stops to limit the deformation of the elastic portions 21, 23, 25, 27. In the embodiment shown (see FIG. 2), recessed wall portions 19 of the plate 3 limit the stroke of the pins 16, 17 to limit the deformation of the elastic portions 21, 25. The end portions 29, 30 of the corrector 2 may serve as stops for the actuation portions 24, 28 to limit the deformation of the elastic portions 23, 27 when handling the corrector 2 during assembling.

The present invention has been described above by way of example only. It will be clearly apparent to one skilled in the art that many modifications may be made without departing from the scope of the appended claims.

For example, if correction in only one direction is desired, the corrector of the invention will consist of half the corrector 2 shown in the figures, including e.g. half of the fixing portion 20, the first elastic portion 21, the first mobile portion 22, the second elastic portion 23 and the first actuation portion 24.

Moreover, the present invention is not limited to the correction of the local time hour indication. It can be used, for example, to quickly correct a date, day or month indication.

Instead of being a corrector, the indicator actuating organ of the present invention could be a driving lever arranged to drive a toothed component that carries the indicator during normal operation of the timepiece. For example, the indicator actuating organ could comprise half the piece 2 shown in FIG. 3 and could have a beak that slides on a cam, typically a snail cam, so that the actuation portion 24 moves a toothed component by one step each time the beak falls from a high point to a low point of the cam, to fulfill a similar function to that described in CH 702137 which is incorporated herein by reference.

Another modification of the invention could consist in replacing the elastic portions 21, 23, 25, 27 or only one or some of them, which guide in rotation, by elastic portions that guide in translation. Each concerned elastic portion could then be in the form of two parallel elastic strips extending in a same plane.

The present invention is notably applicable to wrist watches and pocket watches.

The invention claimed is:

1. An actuating organ for actuating an indicator in a timepiece, said actuating organ comprising:

a fixing portion, a mobile portion, a first elastic portion connecting the mobile portion to the fixing portion, said first elastic portion being arranged to guide the mobile portion relative to the fixing portion and to exert an elastic return action on the mobile portion, an actuation portion arranged to engage with a toothed component of the timepiece upon actuation of the mobile portion relative to the fixing portion so as to actuate said toothed component, thereby actuating said indicator, and a second elastic portion connecting the actuation portion to the mobile portion, said second elastic portion being arranged to guide the actuation portion relative to the mobile portion so as to allow the actuation portion to retract when leaving the toothed component after release of the mobile portion, said second elastic portion being also arranged to exert an elastic return action on the actuation portion.

2. An actuating organ for actuating an indicator in a timepiece, said actuating organ comprising:

a fixing portion, a first mobile portion, a first elastic portion connecting the first mobile portion to the fixing portion, said first elastic portion being arranged to guide the first mobile portion relative to the fixing portion and to exert an elastic return action on the first mobile portion, a first actuation portion arranged to engage with a toothed component of the timepiece upon actuation of the first mobile portion relative to the fixing portion, so as to actuate said toothed component in a first direction, thereby actuating said indicator, a second elastic portion connecting the first actuation portion to the first mobile portion, said second elastic portion being arranged to guide the first actuation portion relative to the first mobile portion so as to allow the first actuation portion to retract when leaving the toothed component after release of the first mobile portion, said second elastic portion being also arranged to exert an elastic return action on the first actuation portion, a second mobile portion, a third elastic portion connecting the second mobile portion to the fixing portion, said third elastic portion being arranged to guide the second mobile portion relative to the fixing portion and to exert an elastic return action on the second mobile portion, a second actuation portion arranged to engage with said toothed component of the timepiece upon actuation of the second mobile portion relative to the fixing portion, so as to actuate said toothed component in a second direction, opposite to said first direction, thereby actuating said indicator, and a fourth elastic portion connecting the second actuation portion to the second mobile portion, said fourth elastic portion being arranged to guide the second actuation portion relative to the second mobile portion so as to allow the second actuation portion to retract when leaving the toothed component after release of the second mobile portion, said fourth elastic portion being also arranged to exert an elastic return action on the second actuation portion.

3. The actuating organ of claim 2, having a symmetrical shape.

4. The actuating organ of claim 1, wherein each of the elastic portions is a rotation guiding portion.

5. The actuating organ of claim 4, wherein each of the elastic portions comprises first and second elastic strips extending in two different parallel planes and crossing each other in top view.

6. The actuating organ of claim 1, made of one piece.

7. The actuating organ of claim 1, wherein said actuating organ is a corrector which may be actuated by a user for setting the position of the indicator.

8. The actuating organ of claim 1, wherein said actuating organ is a driving organ arranged to drive the toothed component during normal operation of the timepiece.

9. A timepiece mechanism comprising an actuating organ, a toothed component for driving an indicator and an isolating organ, said actuating organ comprising:

a fixing portion, a first mobile portion, a first elastic portion connecting the first mobile portion to the fixing portion, said first elastic portion being arranged to guide the first mobile portion relative to the fixing portion and to exert an elastic return action on the first mobile portion, a first actuation portion arranged to engage with the toothed component upon actuation of the first mobile portion relative to the fixing portion, so as to actuate the toothed component in a first direction, thereby actuating said indicator, a second elastic portion connecting the first actuation portion to the first mobile portion, said second elastic portion being arranged to guide the first actuation portion relative to the first mobile portion so as to allow the first actuation portion to retract when leaving the toothed component after release of the first mobile portion, said second elastic portion being also arranged to exert an elastic return action on the first actuation portion, a second mobile portion, a third elastic portion connecting the second mobile portion to the fixing portion, said third elastic portion being arranged to guide the second mobile portion relative to the fixing portion and to exert an elastic return action on the second mobile portion, a second actuation portion arranged to engage with the toothed component upon actuation of the second mobile portion relative to the fixing portion, so as to actuate the toothed component in a second direction, opposite to said first direction, thereby actuating said indicator, and a fourth elastic portion connecting the second actuation portion to the second mobile portion, said fourth elastic portion being arranged to guide the second actuation portion relative to the second mobile portion so as to allow the second actuation portion to retract when leaving the toothed component after release of the second mobile portion, said fourth elastic portion being also arranged to exert an elastic return action on the second actuation portion, wherein the isolating organ is arranged to be moved by one of the first and second mobile portions upon actuation of said one of the first and second mobile portions to prevent the actuation portion corresponding to the other of the first and second mobile portions from engaging with the toothed component if said other of the first and second mobile portions is actuated.

10. The timepiece mechanism of claim 9, wherein the isolating organ is moveable in translation relative to the fixing portion.

11. A timepiece comprising the actuating organ of claim 1.

12. A timepiece comprising the timepiece mechanism of claim 9.

13. The actuating organ of claim 2, wherein each of the elastic portions is a rotation guiding portion.

14. The actuating organ of claim 3, wherein each of the elastic portions is a rotation guiding portion.

15. The actuating organ of claim 2, made of one piece.

16. The actuating organ of claim 3, made of one piece.

17. The actuating organ of claim 4, made of one piece.

18. The actuating organ of claim 5, made of one piece.

19. The actuating organ of claim 2, wherein said actuating organ is a corrector which may be actuated by a user for setting the position of the indicator.

20. The actuating organ of claim 3, wherein said actuating organ is a corrector which may be actuated by a user for selling the position of the indicator.

* * * * *